US010549935B2

(12) United States Patent
Tokoro

(10) Patent No.: US 10,549,935 B2
(45) Date of Patent: Feb. 4, 2020

(54) SHEET CONVEYING DEVICE AND IMAGE FORMING APPARATUS

(71) Applicant: Brother Kogyo Kabushiki Kaisha, Nagoya (JP)

(72) Inventor: Yuji Tokoro, Inazawa (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 16/225,437

(22) Filed: Dec. 19, 2018

(65) Prior Publication Data

US 2019/0212688 A1 Jul. 11, 2019

(30) Foreign Application Priority Data

Jan. 11, 2018 (JP) ..... 2018-002664

(51) Int. Cl.

| | |
|---|---|
| ***B65H 1/00*** | (2006.01) |
| ***G03G 15/00*** | (2006.01) |
| ***B65H 3/66*** | (2006.01) |
| ***B65H 3/06*** | (2006.01) |
| ***B65H 1/04*** | (2006.01) |

(52) U.S. Cl.

CPC ..... *B65H 1/00* (2013.01); *B65H 1/04* (2013.01); *B65H 3/06* (2013.01); *B65H 3/66* (2013.01); *G03G 15/6502* (2013.01); *B65H 2405/113* (2013.01); *B65H 2405/1134* (2013.01); *B65H 2801/03* (2013.01)

(58) Field of Classification Search

CPC ... B65H 1/00; B65H 1/04; B65H 3/06; B65H 3/66; B65H 3/68; B65H 2405/113; B65H 2405/1134; B65H 2405/31; B65H 2405/313; B65H 2405/32; B65H 2405/324; B65H 2405/325; G03G 15/6502

See application file for complete search history.

(56) References Cited

U.S. PATENT DOCUMENTS

2009/0001660 A1 1/2009 Miwa
2009/0010700 A1* 1/2009 Kim ..... B41J 13/103 400/624
2018/0273326 A1* 9/2018 Tatematsu ..... B65H 3/5223

FOREIGN PATENT DOCUMENTS

JP 2009-007123 A 1/2009

* cited by examiner

*Primary Examiner* — David H Bollinger
(74) *Attorney, Agent, or Firm* — Burr & Brown, PLLC

(57) ABSTRACT

A sheet conveying device includes a sheet feed tray with a first guide, a main body with a second guide, a guide member disposed at the sheet feed tray, and a contact portion located at the main body. The sheet feed tray is movable in a first direction. The guide member is movable between a protruding position and a withdrawn position. The guide member at the protruding position is disposed downstream of the first guide in a sheet conveyance direction and upstream of the second guide in the first direction such that the guide member overlaps the second guide in the first direction. The guide member at the withdrawn position does not overlap the second guide in the first direction. The contact portion is configured to, as the sheet feed tray moves from the main body, contact and move the guide member from the protruding position toward the withdrawn position.

8 Claims, 12 Drawing Sheets

SHEET CONVEYING DEVICE AND IMAGE FORMING APPARATUS

CROSS-REFERENCE TO RELATED APPLICATION

This application claims priority from Japanese Patent Application No. 2018-002664 filed on Jan. 11, 2018, the content of which is incorporated herein by reference in its entirety.

FIELD OF DISCLOSURE

Aspects of the disclosure relate to a sheet conveying device configured to convey a sheet from a sheet feed tray and an image forming apparatus including the sheet conveying device.

BACKGROUND

A known sheet conveying device includes a main body and a sheet feed tray that is slidable relative to the main body. The sheet feed tray includes a guide for guiding a sheet from the sheet feed tray to the main body. The main body includes a guide located downstream of the guide of the sheet feed tray in a sheet conveyance direction. These guides facilitate smooth conveyance of sheets at a gap between the main body and the sheet feed tray.

SUMMARY

To prevent a sheet from getting caught in the gap between the main body and the sheet feed tray, a downstream end portion of the guide of the sheet feed tray may be received on an upstream end portion of the guide of the main body, so that the upstream end portion of the guide of the main body does not protrude relative to a sheet to be conveyed. However, the guide of the main body whose upstream end portion receives the downstream end portion of the guide of the sheet feed tray may obstruct the removal of the sheet feed tray from the main body.

One or more aspects of the disclosure are directed to a sheet conveying device configured to enable smooth conveyance of sheets and smooth movement of a sheet feed tray relative to a main body, and directed to an image forming apparatus including the sheet conveying device.

According to an aspect of the disclosure, a sheet conveying device includes a sheet feed tray, a main body, a guide member disposed at the sheet feed tray, and a contact portion located at the main body. The sheet feed tray is configured to support a sheet. The sheet feed tray includes a first guide configured to guide the sheet. The main body includes a tray accommodating portion configured to accommodate the sheet feed tray such that the sheet feed tray is movable in a first direction from an accommodated position where the sheet feed tray is accommodated in the tray accommodating portion toward a drawn position where the sheet feed tray is drawn from the tray accommodating portion. The main body further includes a feed roller and a second guide. The feed roller is disposed upstream of the first guide when the sheet feed tray is at the accommodated position. The feed roller is configured to convey a sheet in a sheet conveyance direction from the sheet feed tray accommodated in the tray accommodating portion to the first guide. The second guide is configured to guide the sheet conveyed by the feed roller from the sheet feed tray accommodated in the tray accommodating portion. The guide member is movable between a protruding position and a withdrawn position. When the guide member is at the protruding position, the guide member is disposed downstream of the first guide in the sheet conveyance direction and upstream of the second guide in the first direction such that the guide member overlaps the second guide in the first direction. When the guide member is at the withdrawn position, the guide member does not overlap the second guide in the first direction. The contact portion is configured to, as the sheet feed tray moves from the tray accommodating portion, contact and move the guide member from the protruding position toward the withdrawn position.

The sheet conveying device structured above and an image forming apparatus including the sheet conveying device enable smooth conveyance of sheets and smooth movement of the sheet feed tray relative to the main body.

More specifically, the guide member of the sheet conveying device enables smooth conveyance of sheets from the first guide to the second guide and smooth movement of the sheet feed tray relative to the main body.

DETAILED DESCRIPTION

An illustrative embodiment of the disclosure will be described with reference to the accompanying drawings.

Overall Structure of Image Forming Apparatus

Figure 1:
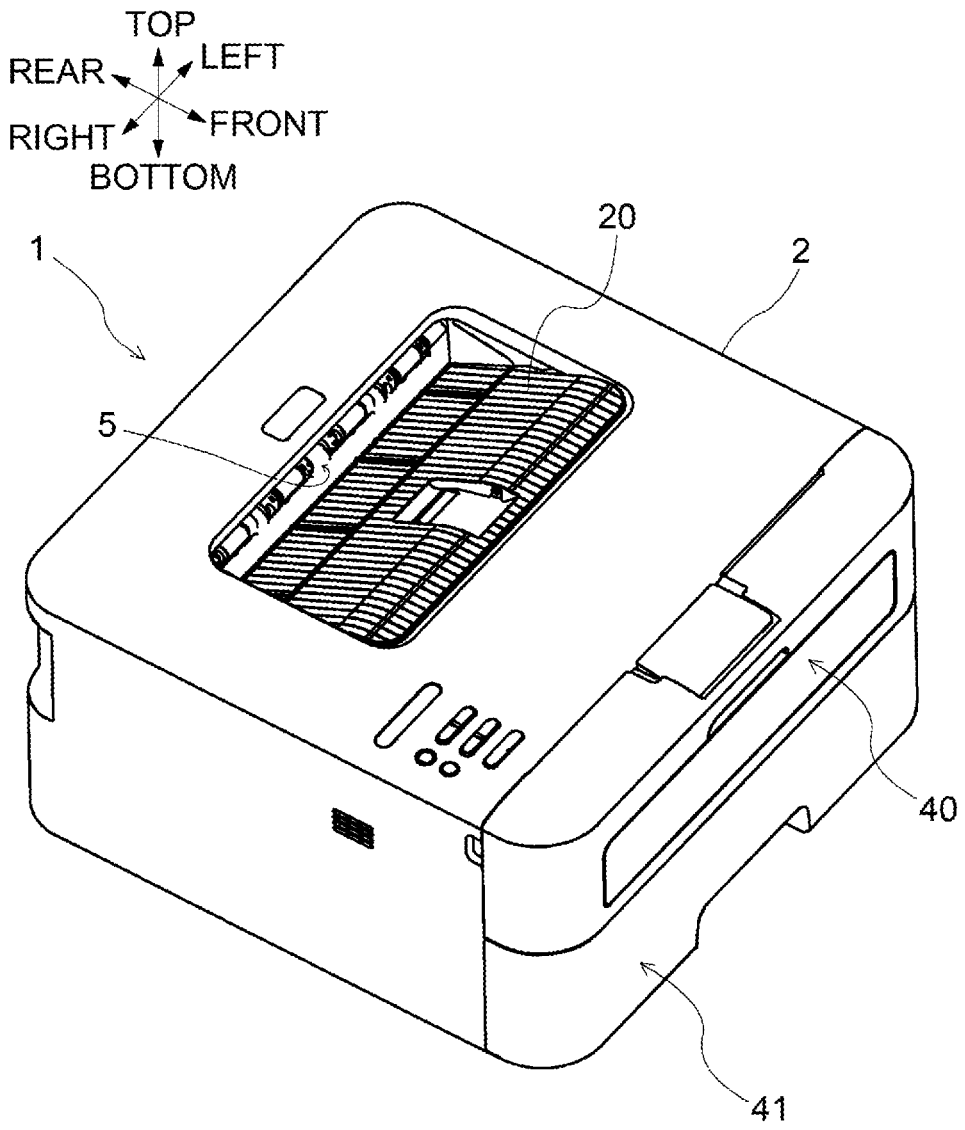
FIG. 1 is a perspective view of an image forming apparatus including a sheet conveying device.
Figure 2:
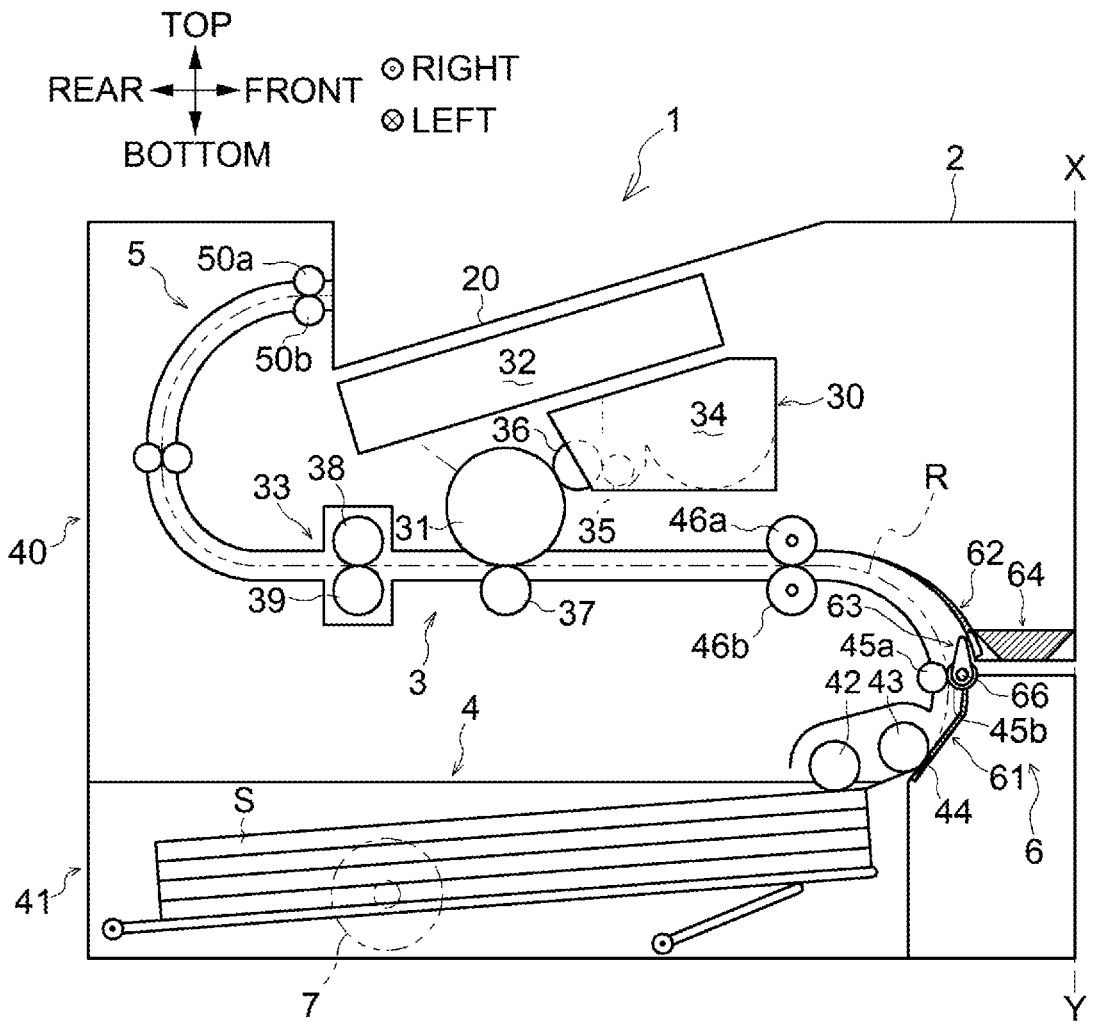
FIG. 2 is a cross sectional view of the image forming apparatus with a sheet feed tray at an accommodated position.

An image forming apparatus 1 illustrated in FIGS. 1 and 2 is an example of an image forming apparatus according to an aspect of the disclosure. The image forming apparatus 1 includes a casing 2, an image forming unit 3 configured to form an image on a sheet S, a sheet feed unit 4 configured to feed a sheet S to the image forming unit 3, a discharge unit 5 configured to discharge a sheet having an image formed at the image forming unit 3 outside of the casing 2, and a motor 7 as a drive source.

In the following description, directions are defined based on FIG. 2. In FIG. 2, a right side is defined as a front or front side of the image forming apparatus 1, a left side is defined as a rear or rear side of the image forming apparatus 1, a side facing out of the page is defined as a right or right side of the image forming apparatus, a side facing into the page is defined as a left or left side of the image forming apparatus 1, an upper side is defined as a top or upper side of the image forming apparatus 1, and a lower side is defined as a bottom or lower side of the image forming apparatus 1.

The casing 2 is box-shaped, and accommodates the image forming unit 3, the sheet feed unit 4, the discharge unit 5, and the motor 7. The casing 2 has an upper surface defining a sheet discharge tray 20. The sheet discharge tray 20 is recessed downward relative to the upper surface and inclined downward to the rear.

The image forming unit 3 is disposed above the sheet feed unit 4, and includes a process cartridge 30 configured to transfer an image on a sheet S conveyed from the sheet feed unit 4, an exposure unit 32 configured to expose a surface of a photosensitive drum 31 in the process cartridge 30, and a fixing unit 33 configured to fix the image transferred on the sheet S by the process cartridge 30.

The process cartridge 30 includes a toner cartridge 34, a supply roller 35, a developing roller 36, the photosensitive drum 31, and a transfer roller 37.

The toner cartridge 34 contains toner, which is a developing agent. Toner in the toner cartridge 34 is supplied to the supply roller 35 while being agitated by an agitating member (not illustrated). The supply roller 35 supplies toner in the toner cartridge 34 to the developing roller 3.

The exposure unit 32 includes a laser diode, a polygon mirror, a lens, and a reflecting mirror, and is configured to emit a laser beam onto a surface of the photosensitive drum 31 based on image data inputted in the image forming apparatus 1 to expose the surface.

The photosensitive drum 31 is disposed adjacent to the developing roller 36. The surface of the photosensitive drum 31 is positively and uniformly charged by a charger (not illustrated), and then exposed by the exposure unit 32. Exposed areas on the surface of the photosensitive drum 31 are lower in electric potential than the other areas thereon, so that an electrostatic latent image is formed on the surface of the photosensitive drum 31 based on the image data. The electrostatic latent image on the surface of the photosensitive drum 31 is developed into a visible developer image with positively charged toner supplied from the developing roller 36.

The transfer roller 37 is disposed facing the photosensitive drum 31, and receives a negative transfer bias from a bias applying member (not illustrated). While a sheet S is nipped at a transfer position between the transfer roller 37 receiving the transfer bias and the photosensitive drum 31 carrying the developer image thereon, the developer image on the photosensitive drum 31 is transferred to the sheet S.

The fixing unit 33 includes a heat roller 38 and a pressure roller 3. The heat roller 38 is driven by a drive force from the motor 7, and is heated by electric power supplied from a power source (not illustrated). The pressure roller 39 is disposed facing the heat roller 38, and rotated by the rotation of the heat roller 38. The sheet S having the developer image is conveyed to the fixing unit 33, in which the sheet S is nipped and conveyed by the heat roller 38 and the pressure roller 39, and thus the developer image is fixed onto the sheet S.

The sheet feed unit 4 includes a sheet feed tray 41, a feed roller 42, a separation roller 43, a separation pad 44, conveying rollers 45*a*, 45*b*, and registration rollers 46*a*, 46*b*. The casing 2 defines inside a conveying path R extending from the sheet feed tray 41 via the image forming unit 3 to the sheet discharge tray 20.

The sheet feed tray 41 supports a stack of sheets S. The feed roller 42 feeds a sheet S from the sheet feed tray 41 toward the separation roller 43. The sheet S is singly separated from subsequent sheets S by the separation roller 43 and the separation pad 44 and fed along the conveying path R.

Figure 3:
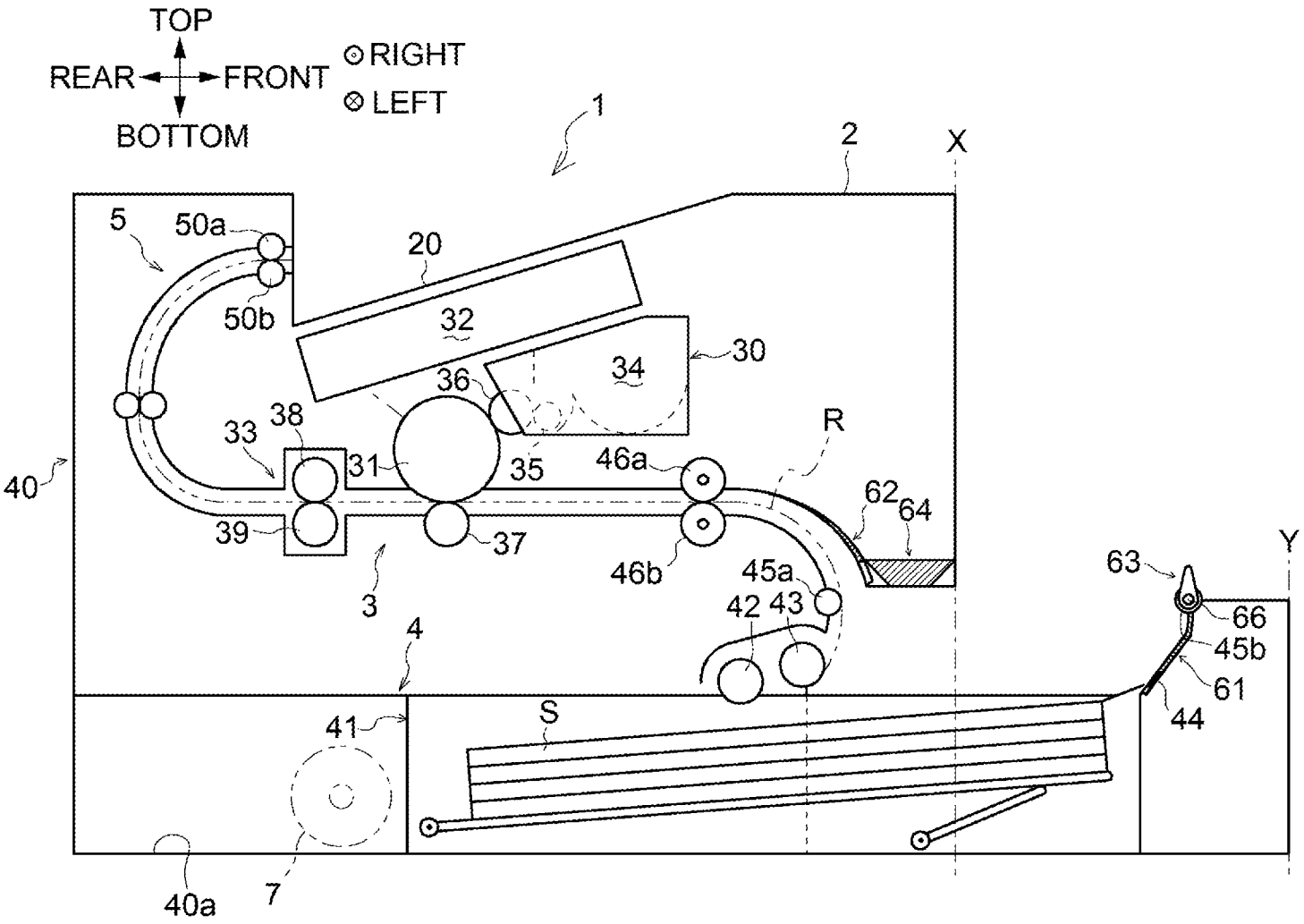
FIG. 3 is a cross sectional view of the image forming apparatus with the sheet feed tray at a withdrawn position.

As illustrated in FIG. 3, the image forming apparatus 1 without the sheet feed tray 41 may refer to a main body 40. The main body 40 includes a tray accommodating portion 40*a* configured to accommodate the sheet feed tray 41. The sheet feed tray 41 is movable, for example, slidable, in the front-rear direction along inner side portions defining the tray accommodating portion 40*a*.

As illustrated in FIG. 2, when a front end X of the main body 40 and a front end Y of the sheet feed tray 41 are aligned with each other, the sheet feed tray 41 is at an accommodated position where it is accommodated in the tray accommodating portion 40*a*. As illustrated in FIG. 3, the front end Y of the sheet feed tray 41 is located to the front relative to the front end X of the main body 40, the sheet feed tray 41 is at a drawn position where it is drawn from the tray accommodating portion 40*a*.

As illustrated in FIG. 2, a sheet S fed along the conveying path R is conveyed by the conveying rollers 45*a*, 45*b* toward the image forming unit 3. The registration rollers 46*a*, 46*b* are disposed downstream of the conveying rollers 45*a*, 45*b* along the conveying path R. The registration rollers 46*a*, 46*b* temporarily stop the leading end of a sheet S, and then feed the sheet S toward the transfer position in the image forming unit 3 at a predetermined time.

The discharge unit 5 includes discharge rollers 50*a*, 50*b* and is configured to discharge the sheet conveyed from the fixing unit 33 outside of the casing 2. More specifically, the discharge rollers 50*a*, 50*b* are configured to discharge the sheet S conveyed from the fixing unit 33 to the sheet discharge tray 20.

As illustrated in FIG. 2, the image forming apparatus 1 includes a sheet conveying device 6 disposed in the conveying path R between the image forming unit 3 and the sheet feed unit 4. The sheet conveying device 6 is an example of a sheet conveying device according to aspects of the disclosure.

Structure of Sheet Conveying Device

Figure 4:
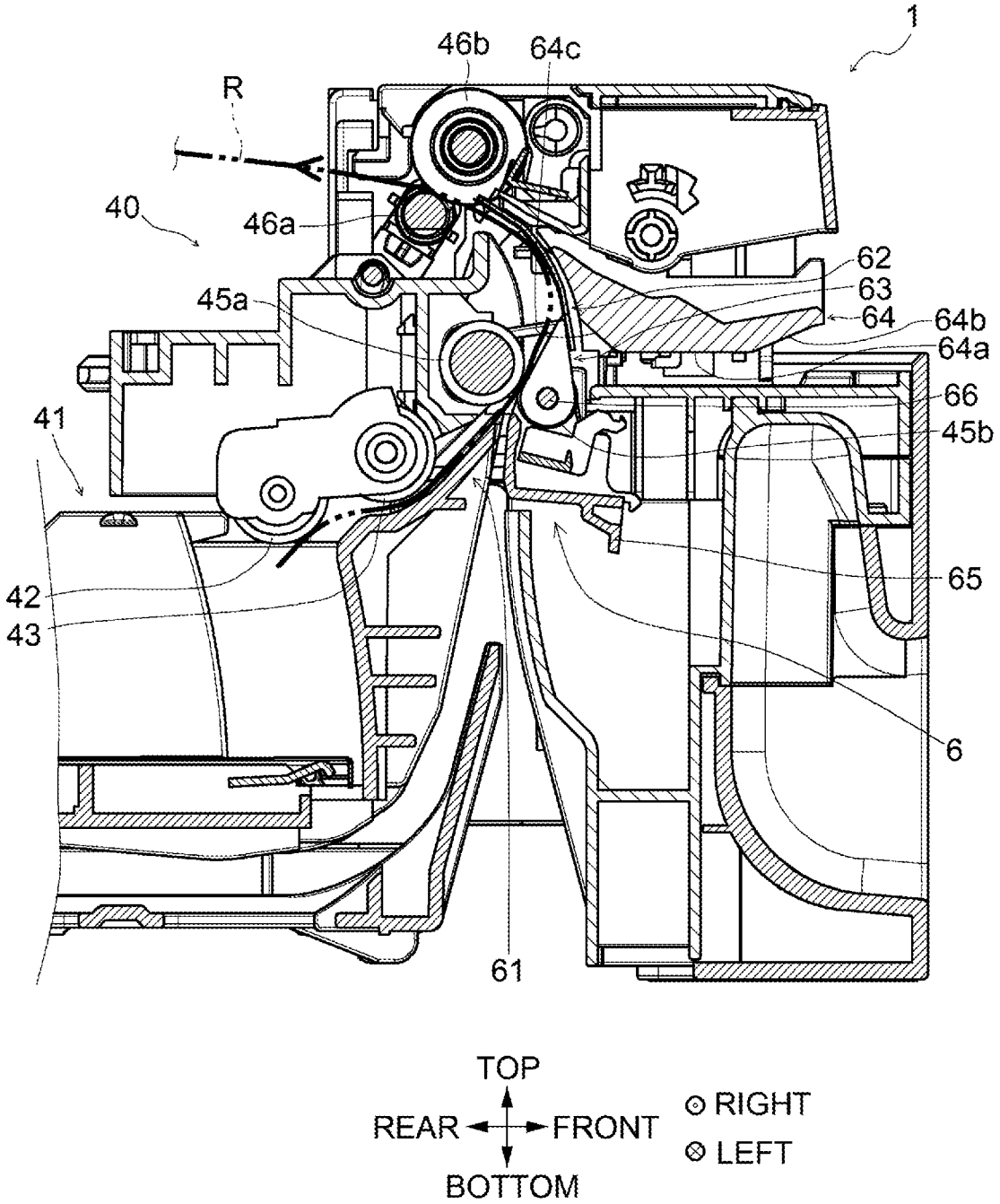
FIG. 4 is a cross sectional view of the sheet conveying device
Figure 5:
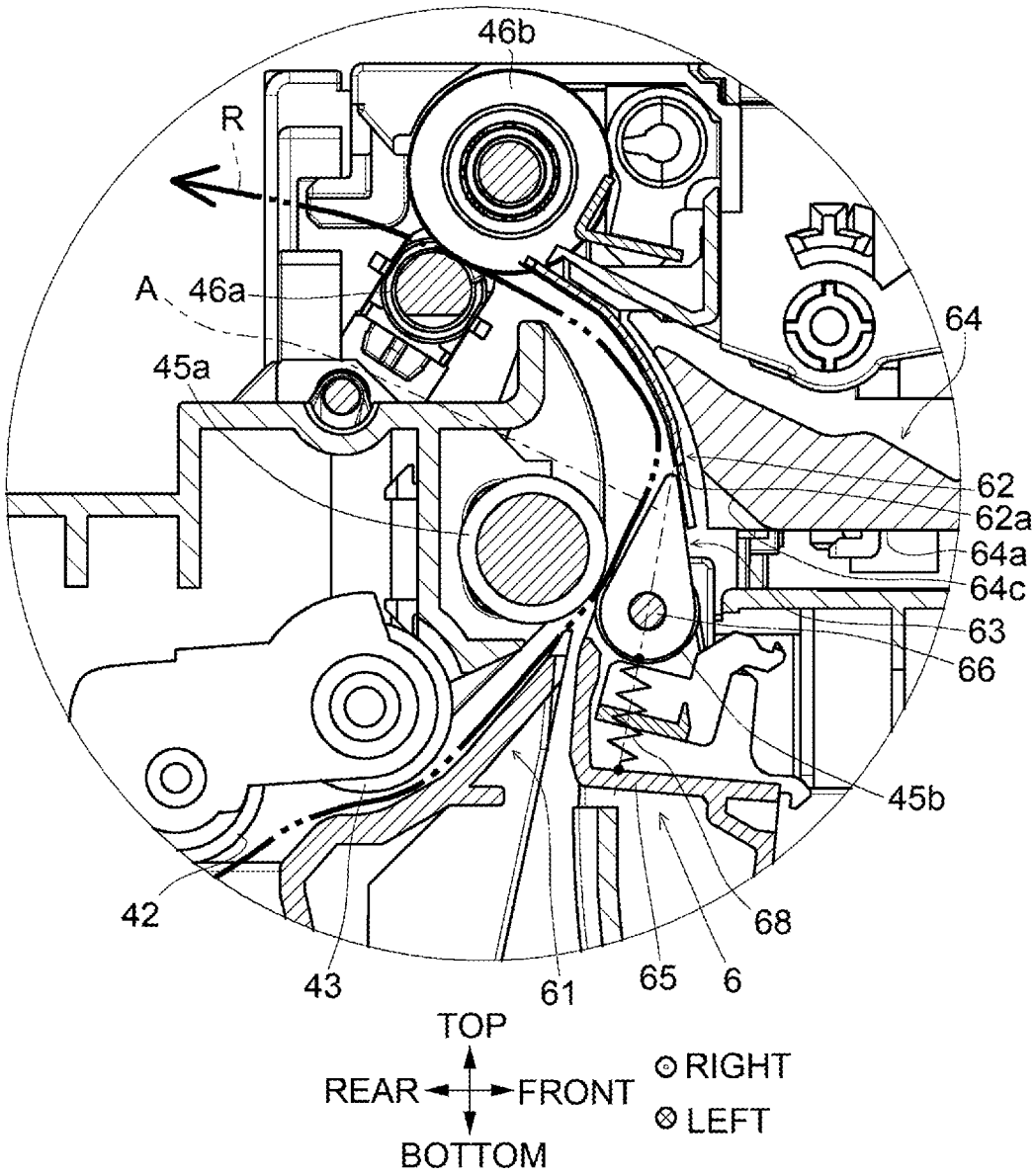
FIG. 5 is an enlarged cross sectional view of the sheet conveying device.

As illustrated in FIGS. 2, 4, and 5, the sheet conveying device 6 includes a first guide 61, a second guide 62, a third guide 63, a contact portion 64, and a holder 65.

The first guide 61 is a wall portion of the sheet feed tray 41, which is located downstream of the separation roller 43 in a sheet conveyance direction in which a sheet is conveyed. After passing through the separation roller 43, the sheet S is conveyed along the first guide 61 such that a surface of the sheet S faces the first guide 61.

The second guide 62 is a wall portion of the main body 40, which is located downstream of the conveying rollers 45*a*, 45*b* in the sheet conveyance direction. After passing through the conveying rollers 45*a*, 45*b*, the sheet S is conveyed along the second guide 62 such that a surface of the sheet S faces the second guide 62.

As illustrated in FIG. 5, the first guide 61 and the second guide 62 are provided to smoothly convey a sheet S at a corner where the direction of the conveying path R is changed from the front to the rear. The second guide 62 has a lower end located to the front further than an upper end of the first guide 61. This structure prevents a leading end of the sheet S conveyed from the sheet feed tray 41 from getting caught on the main body 40. In other words, a gap is left between the first guide 61 of the sheet feed tray 41 and the second guide 62 of the main body 40.

Structure of Third Guide

The third guide 63 includes guide members 67. The guide members 67 are disposed at the sheet feed tray 41 to bridge the gap between the first guide 61 and the second guide 62.

Figure 6:
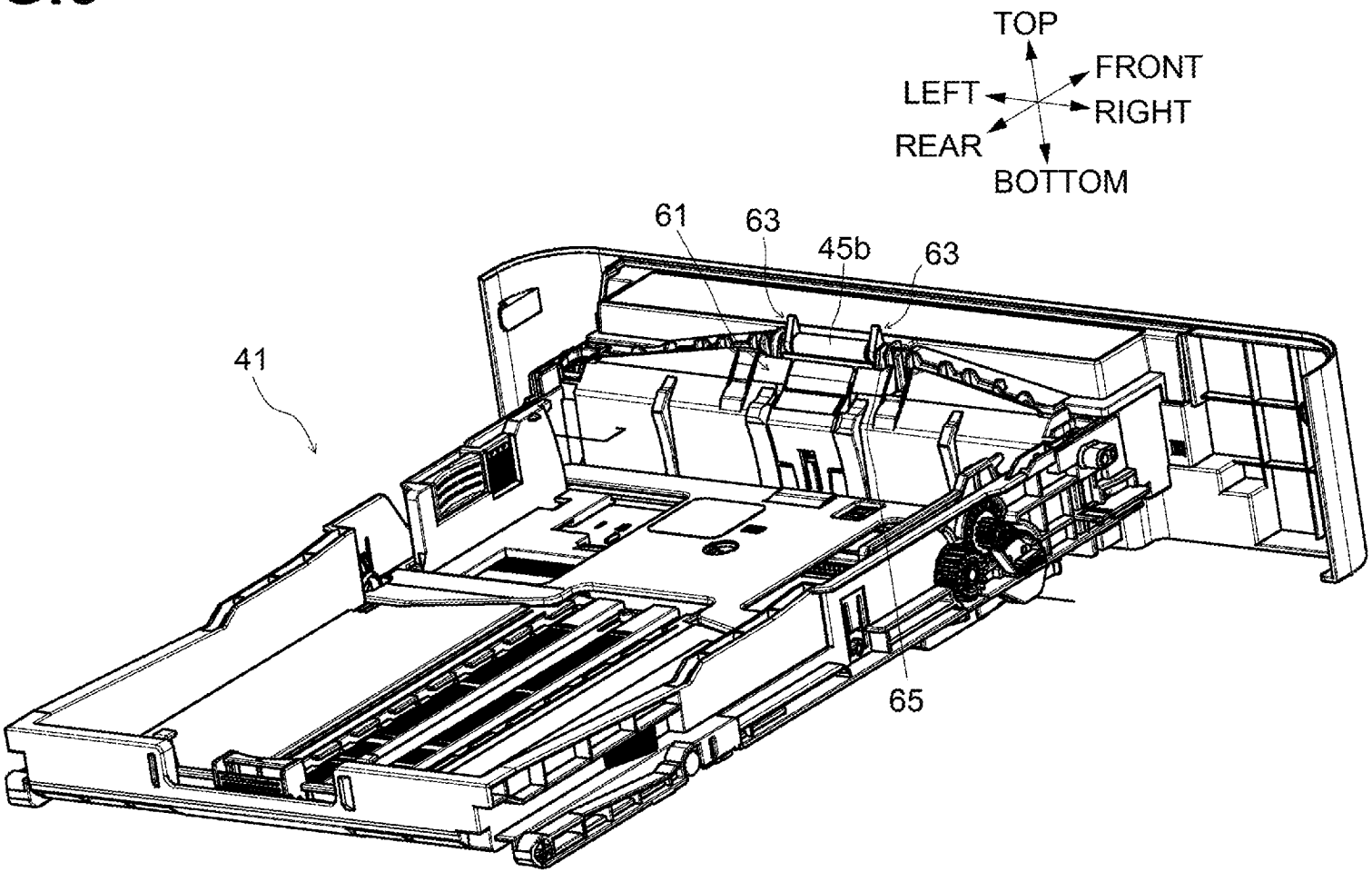
FIG. 6 is a perspective view of the sheet feed tray.

As illustrated in FIG. 6, the holder 65 is received in a specified position of the sheet feed tray 41.

Figure 7A:
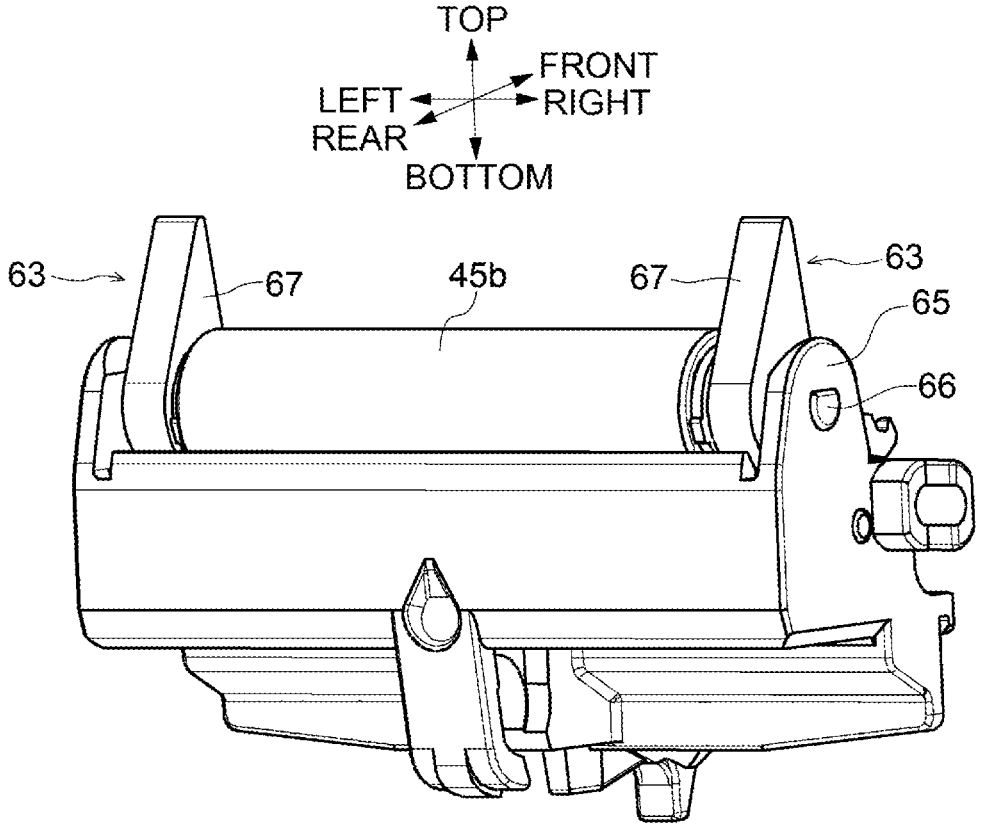
FIG. 7A is a perspective view of a holder supporting a third guide and a conveying roller.

As illustrated in FIG. 6, the holder 65 is received in the specified position of the sheet feed tray 41 and supports a rotation shaft 66 extending in the left-right direction. As illustrated in FIG. 7A, the guide members 67 are pivotally supported by the rotation shaft 66 in the holder 65. The rotation shaft 66 also serves as a rotation shaft of the conveying roller 45*b*. The guide members 67 are disposed coaxially with the conveying roller 45*b*. The conveying roller 45*b* is configured to collect foreign matter adhering to a sheet S, such as paper dust, and may be a roller made of fluorocarbon resin or have a surface coated with fluorocarbon resin. The conveying roller 45*b* is disposed in contact with the conveying roller 45*a*, and rotated by rotation of the conveying roller 45*a*.

Figure 7B:
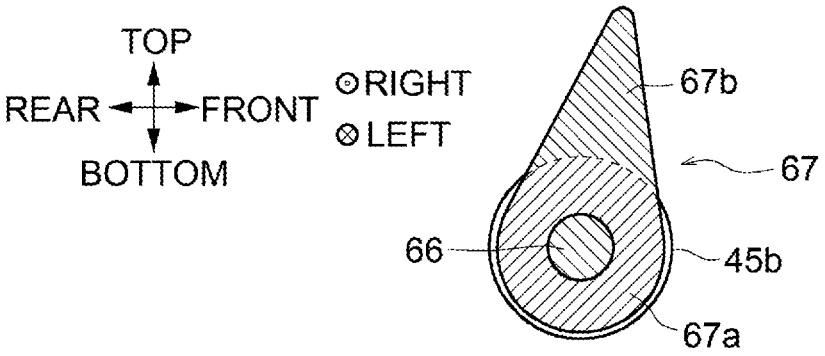
FIG. 7B is a side view of the third guide having a first area and a second area.

As illustrated in FIG. 7B, when viewed in an axial direction of the rotation shaft 66, each of the guide members 67 has a first area 67*a* and a second area 67*b*. The first area 67*a* has an outer diameter smaller than an outer diameter of the conveying roller 45*b*. The second area 67*b* has an outer diameter greater than the outer diameter of the conveying roller 45*b*. As illustrated in FIG. 7A, the guide members 67 are attached to the rotation shaft 66, adjacent to respective ends of the conveying roller 45*b* in the axial direction.

As the guide members 67 each have the first area 67*a*, the third guide 63 is out of a position where a sheet S contacts the conveying roller 45*b*, that is, the third guide 63 does not impart a resistance to the sheet S to be conveyed. The guide members 67 are attached to the rotation shaft 66 coaxially with the conveying roller 45*b*. This positional relationship provides an accurate distance between the conveying roller 45*b* and each of the guide members 67 and contributes to a compact design of the sheet conveying device 6.

Figure 8:
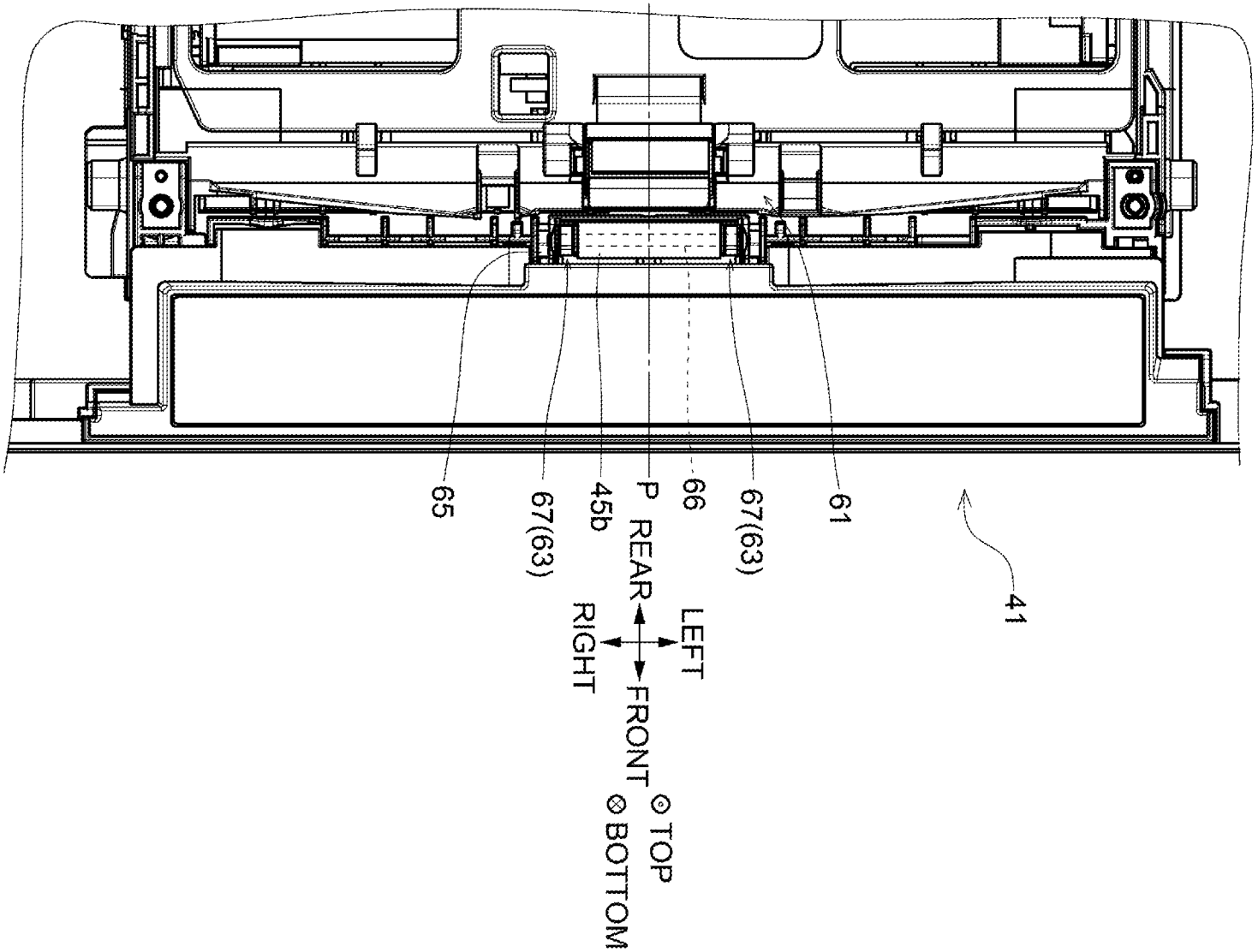
FIG. 8 is an enlarged partial plan view of the sheet feed tray.
Figure 9:
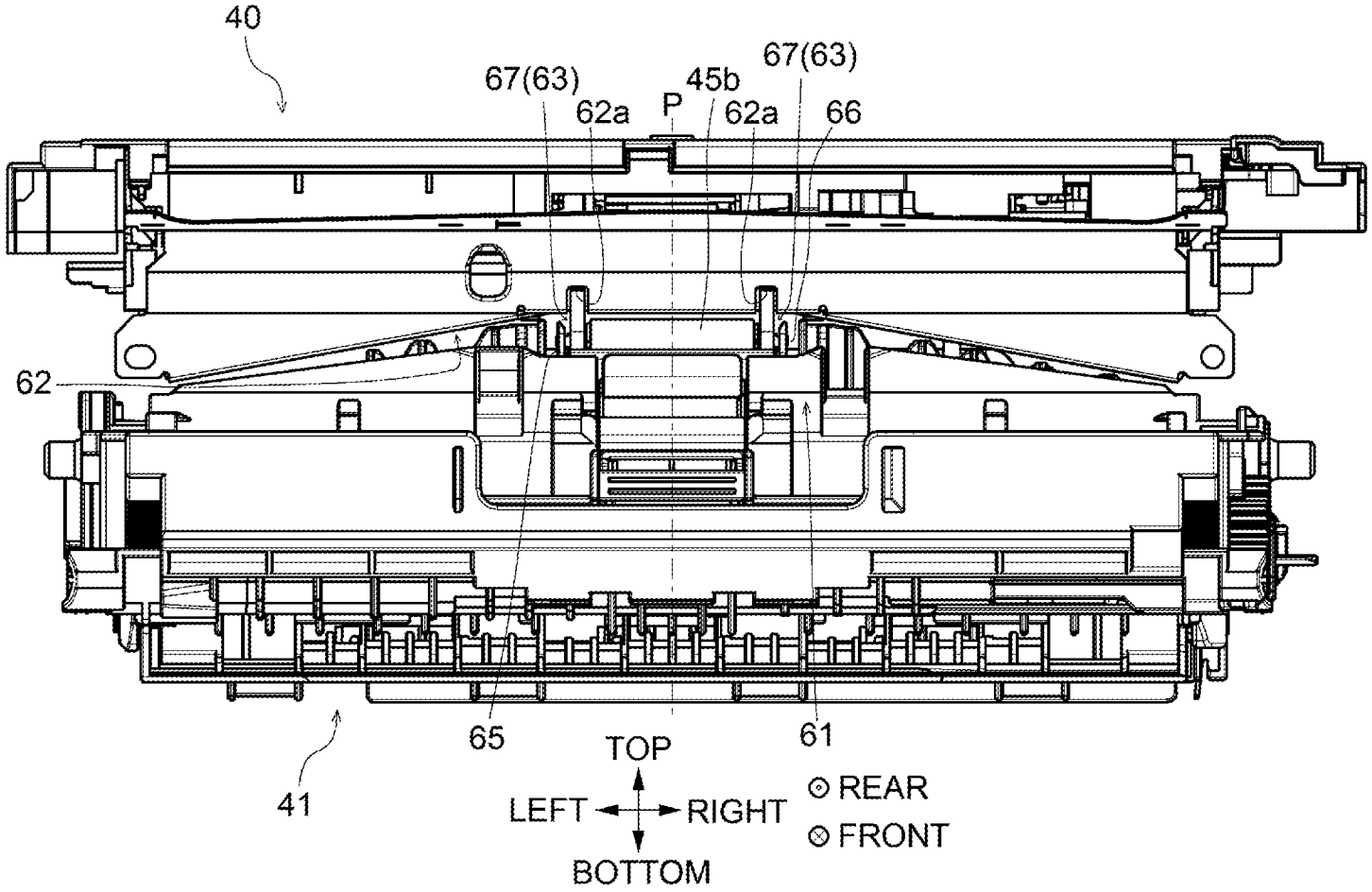
FIG. 9 is a rear view of the sheet feed tray at the accommodated position and a main body.

As illustrated in FIGS. 8 and 9, the guiding members 67 of the third guide 63 are located symmetrically relative to a center line P of the sheet feed tray 41. The center line P is parallel to the sheet conveyance direction. This structure prevents a sheet S from being conveyed obliquely in the conveying path R.

Structure of Contact Portion

As illustrated in FIGS. 2, 4, and 5, the contact portion 64 is disposed in front of the second guide 62 in the main body 40, and has a guide surface 64*a*. When the sheet feed tray 41 is slid in the front-rear direction in the tray accommodating portion 40*a*, the third guide 63 contacts the guide surface 64*a* and then move to a withdrawn position B. The guide surface 64*a* is a flat surface parallel to the front-rear direction and the left-right direction, and is located below a lower end of the second guide 62.

The contact portion 64 has a first inclined guide surface 64*b*, which is connected to a front end of the guide surface 64*a*, and a second inclined guide surface 64*c*, which is connected to a rear end of the guide surface 64*a*. The first inclined guide surface 64*b* and the second inclined guide surface 64*c* are inclined relative to a sliding direction (or the front-rear direction) where the sheet feed tray 41 is slid. The first inclined guide surface 64*b* is inclined upward toward the front, and the second inclined guide surface 64*c* is inclined upward toward the rear.

The sheet conveying device 6 includes the contact portion 64. When the sheet feed tray 41 is moved in and out relative to the tray accommodating portion 40*a*, the contact portion 64 allows the third guide 63 to smoothly pivot, thus reducing damage to the guide members 67 constituting the third guide 63.

Position of Third Guide

Figure 10:
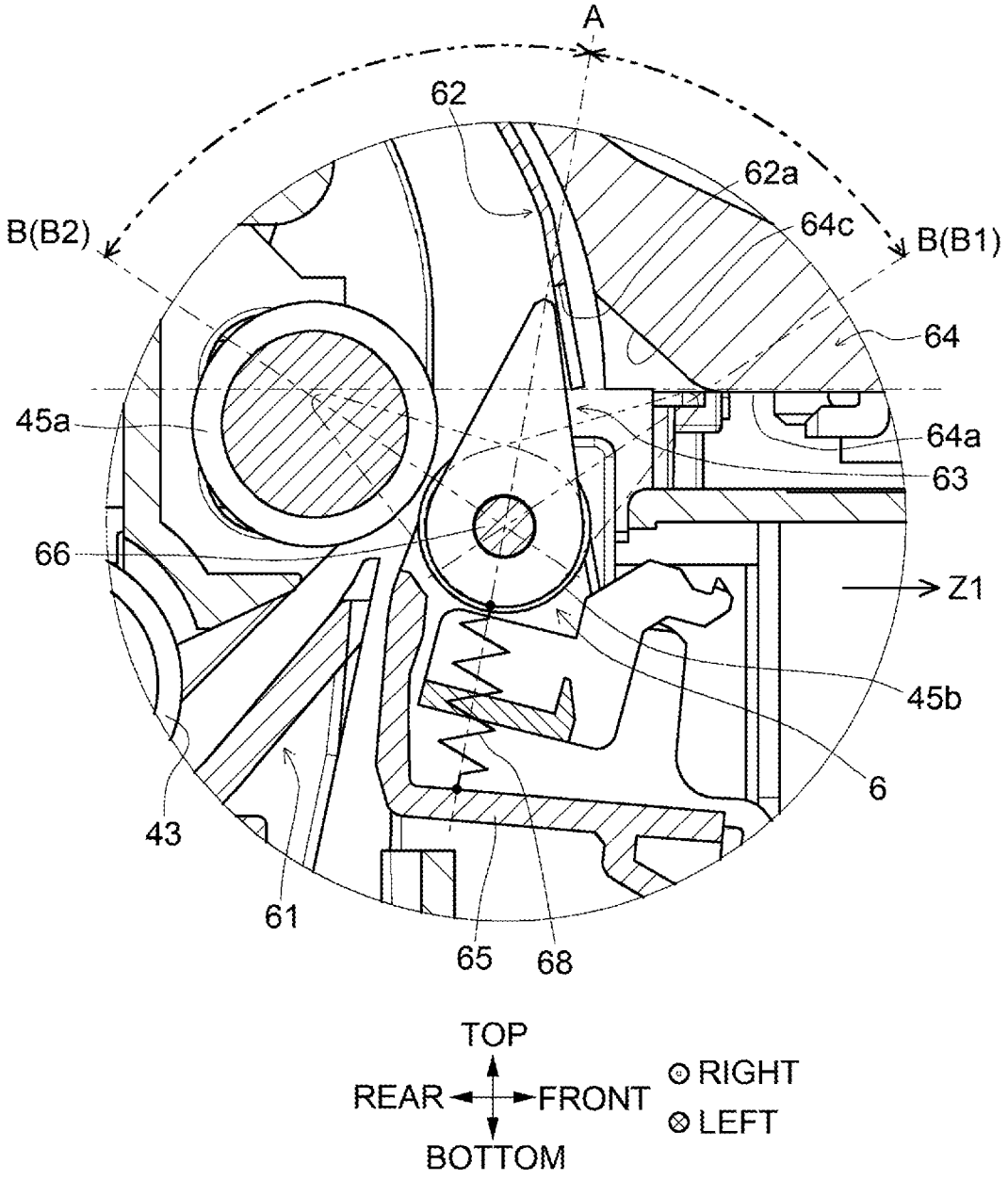
FIG. 10 is an enlarged partial sectional view of the third guide with its pivotal range.

The guide members 67 of the third guide 63 are movable or pivotable about the rotation shaft 66 between a protruding position A and withdrawn positions B illustrated in FIG. 10.

When the second guide 62 is located downstream of the first guide 61 in a sheet conveyance direction where a sheet S is conveyed by the feed roller 42, and a direction where the sheet feed tray 41 is slid from the accommodated position to the drawn position is referred to as a first direction Z1, the third guide 63, e.g., the guiding members 67, is located upstream of the second guide 62 in the first direction Z1 and overlap the second guide 62 in the first direction Z1. This is the protruding position A. Here, "the third guide 63 overlaps the second guide 62" refers to a state where the guiding member 67 is partially located above the lower end of the second guide 62.

The withdrawn positions B refers to any positions where the third guide 63 does not overlap the second guide 62 in the first direction Z1. Here, "the third guide 63 does not overlap the second guide 62" refers to a state where the guide member 67 is entirely located below the lower end of the second guide 62.

The withdrawn positions B includes a first withdrawn position B1 where the guide member 67 has pivoted to the front from the protruding position A, and a second withdrawn position B2 where the guide member 67 has pivoted to the rear from the protruding position A. The guide member 67 is pivotable at least in a range between the withdrawn positions B1, B2, which sandwich the protruding position A therebetween.

Operation of Third Guide when Sheet Feed Tray is Slid

Figure 11:
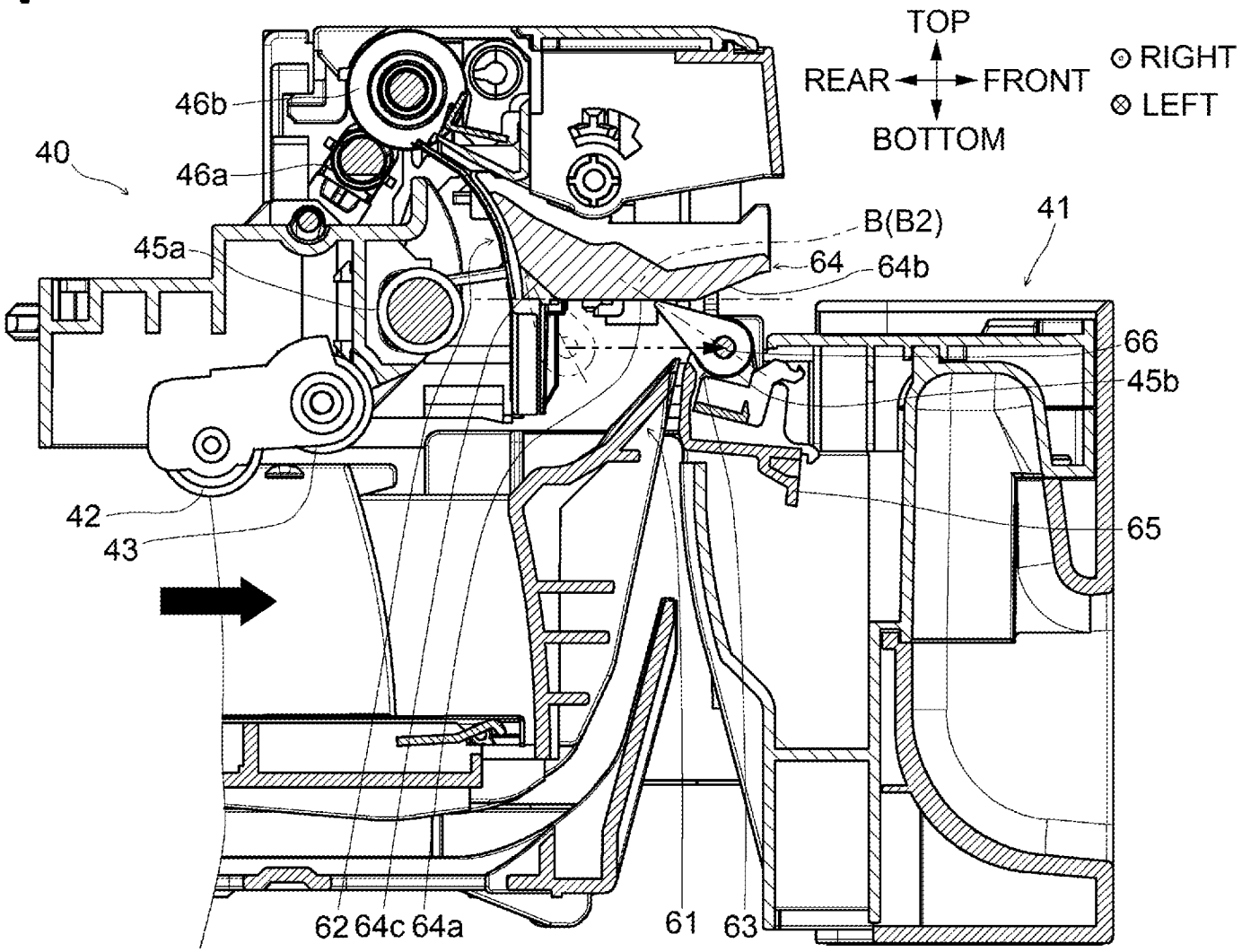
FIG. 11 is a partial sectional view illustrating the third guide being pivoted while the sheet feed tray is drawn.

As illustrated in FIG. 11, while the sheet feed tray 41 is slid out from the tray accommodating portion 40*a*, the third guide 63, e.g., the guide member 67, contacts the second inclined guide surface 64*c* of the contact portion 64 and tilt toward the second withdrawn position B2. When the third guide 63 contacts the guide surface 64*a* of the contact portion 64, the third guide 63 is located at the second withdrawn position B2. When the third guide 63 further contacts the first inclined guide surface 64*b* of the contact portion 64, the third guide 63 tilts toward the protruding position A. When the sheet feed tray 41 is slid outside until the third guide 63 is apart from the contact portion 64, the third guide 63 is located at the protruding position A.

Figure 12:
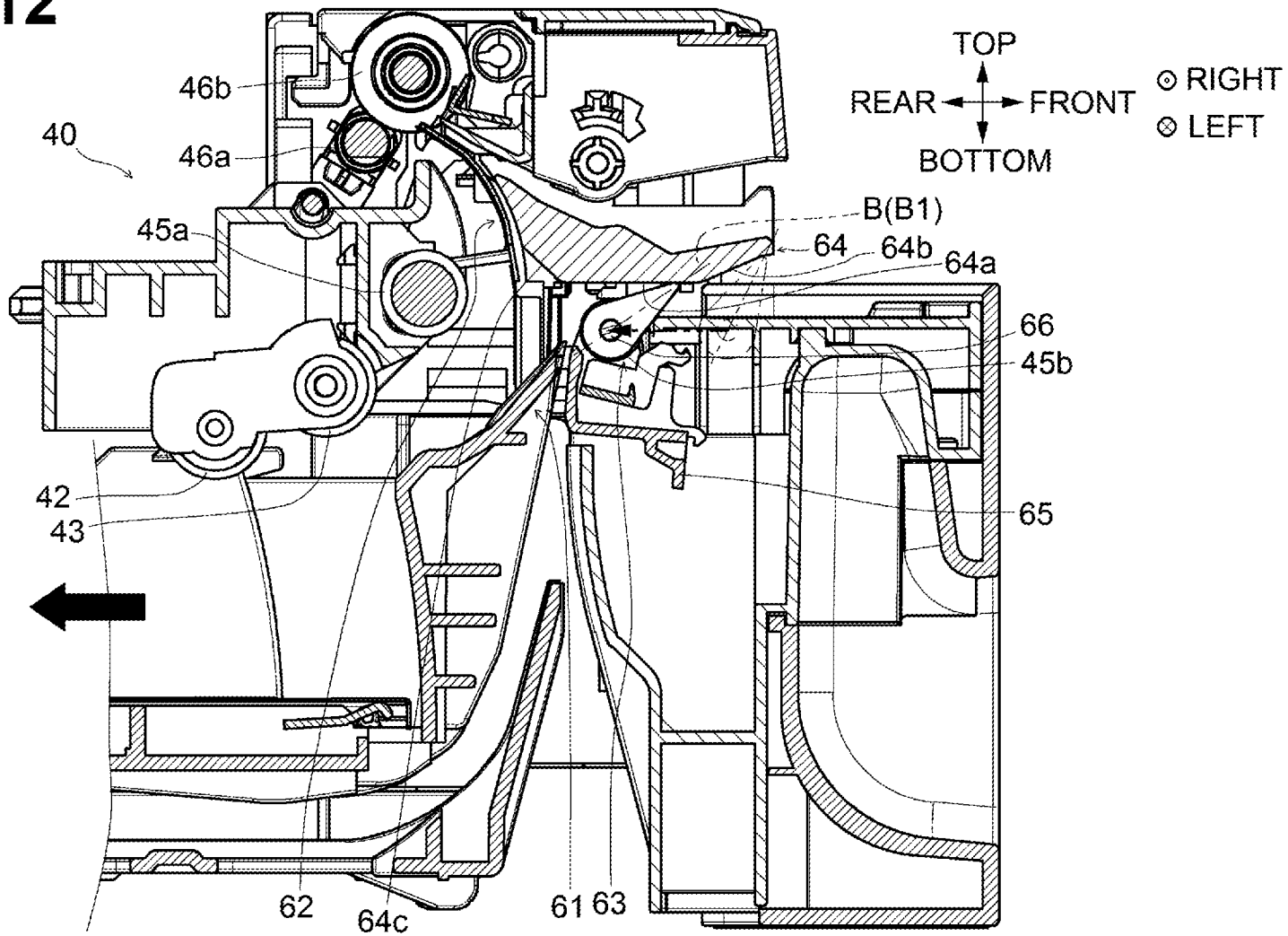
FIG. 12 is a partial sectional view of the third guide being pivoted while the sheet feed tray is inserted.

As illustrated in FIG. 12, while the sheet feed tray 41 is slid in the tray accommodating portion 40*a*, the third guide 63 contacts the first inclined guide surface 64*b* of the contact portion 64 and tilt toward the first withdrawn position B1. When the third guide 63 contacts the guide surface 64*a* of the contact portion 64, the third guide 63 is located at the first withdrawn position B1. When the third guide 63 further contacts the second inclined guide surface 64*c* of the contact portion 64, the third guide 63 tilts toward the protruding position A. When the sheet feed tray 41 is slid inside until the third guide 63 is apart from the contact portion 64, the third guide 63 is located at the protruding position A.

Returning Operation of Third Guide to Protruding Positions

The third guide 63 includes springs 68. Each spring 68 has one end fixed to the holder 65 and the other end engaged with a corresponding one of the guide members 67. Each spring 68 is stretched from its natural length, and the one end is fixed at a position where a line defining the protruding position A crosses the holder 65. The springs 68 thus always urge the corresponding guide members 67 toward the protruding position A. When the guide members 67 are caused to pivot away from the protruding position A and then do not receive any external force, the guide members 67 return to the protruding position A under the forces of the springs 68. In other words, when the sheet feed tray 41 is at the accommodated position, the springs 68 reliably maintain the third guide 63 at the protruding position A.

Effects of Third Guide

As illustrated in FIG. 10, when the sheet feed tray 41 is at the accommodated position, the third guide 63 including the guide members 67 is located at the protruding position A, and pivotable in a direction from the protruding position A toward the second guide 62. In other words, when the sheet feed tray 41 is at the accommodated position, a space is left between each of the guide members 67 and the second guide 62. After the sheet S conveyed along the curved conveying path R exits from between the conveying rollers 45*a*, 45*b*, the trailing end of the sheet S is moved outward due to centrifugal force, thus hitting the guide members 67. When the trailing end hits the guide members 67, the guide members 67 pivot and absorb the impact generated by the hit.

If it were not for the third guide 63, the trailing end of the sheet S would hit the second guide 62 with the impact noise. However, this structure enables the third guide 63 to absorb the impact from the sheet S hitting the third guide 63, thus reducing such an impact noise.

Effects of Cutout Portion in Second Guide

In the sheet conveying device 6, the second guide 62 has cutout portions 62*a*. As illustrated in FIG. 9, the cutout portions 62*a* are sized greater than outlines of respective guide members 67 of the third guide 63. As illustrated in FIG. 10, when viewed in the first direction Z1, the cutout portions 62*a* are defined at positions where the second guide 62 overlaps the guide members 67 of the third guide 63. The sheet conveying device 6 enables the third guide 63 to slightly pivot back and forth relative to the second guide 62 through the cutout portions 62*a* in the second guide 62, while being kept close to the protruding position A. When the sheet feed tray 41 is at the accommodated position, the third guide 63 is pivotable about the rotation shaft 66 back and forth through the cutout portions 62*a*.

The third guide 63 is pivotable through the cutout portions 62*a*, and their pivoting range varies depending on the impact when the sheet S hits the guide members 67. When the sheet feed tray 41 is slid in or out from the tray accommodating portion 40*a*, the guide members 67 of the third guide 63 pivot through the cutout portions 62*a*, and thus smoothly move between the protruding position A and the withdrawn position B.

The image forming apparatus 1 includes the sheet conveying device 6 with the third guide 63 described above, enabling smooth conveyance of sheets S from the first guide 61 to the second guide 62 and smooth movement of the sheet feed tray 41 relative to the apparatus.

What is claimed is:

1. A sheet conveying device comprises:

a sheet feed tray configured to support a sheet, the sheet feed tray including a first guide configured to guide the sheet;

a main body including:

a tray accommodating portion configured to accommodate the sheet feed tray such that the sheet feed tray is movable in a first direction from an accommodated position where the sheet feed tray is accommodated in the tray accommodating portion toward a drawn position where the sheet feed tray is drawn from the tray accommodating portion;

a feed roller disposed upstream of the first guide when the sheet feed tray is at the accommodated position, the feed roller being configured to convey a sheet in a sheet conveyance direction from the sheet feed tray accommodated in the tray accommodating portion to the first guide; and a second guide configured to guide the sheet conveyed by the feed roller from the sheet feed tray accommodated in the tray accommodating portion;

a guide member disposed at the sheet feed tray, the guide member being movable between a protruding position and a withdrawn position, wherein, when the guide member is at the protruding position, the guide member is disposed downstream of the first guide in the sheet conveyance direction and upstream of the second guide in the first direction such that the guide member overlaps the second guide in the first direction, and wherein, when the guide member is at the withdrawn position, the guide member does not overlap the second guide in the first direction; and a contact portion located at the main body, the contact portion being configured to, as the sheet feed tray moves from the tray accommodating portion, contact and move the guide member from the protruding position toward the withdrawn position.

2. The sheet conveying device according to claim 1, wherein, when the sheet feed tray is accommodated in the tray accommodating portion, the guide member is at the protruding position and is pivotable in a direction from the protruding position toward the second guide.

3. The sheet conveying device according to claim 1, further comprising a spring disposed at the sheet feed tray and engaged with the guide member, wherein the spring urges the guide member toward the protruding position.

4. The sheet conveying device according to claim 1, wherein the sheet feed tray includes a roller configured to contact the sheet, and the guide member is pivotable about a rotation axis of the roller.

5. The sheet conveying device according to claim 4, wherein the guide member has a first area and a second area, the first area having an outer diameter smaller than an outer diameter of the roller, the second area having an outer diameter greater than the outer diameter of the roller.

6. The sheet conveying device according to claim 1, wherein the contact portion has an inclined guide surface inclined relative to the first direction.

7. The sheet conveying device according to claim 1, further comprising another guide member, wherein the guide member and the other guide member are located symmetrically relative to a center line of the sheet feed tray, the center line being parallel to the sheet conveyance direction.

8. An image forming apparatus comprising:

a sheet feed tray configured to support a sheet, the sheet feed tray including a first guide configured to guide the sheet;

a main body including:

an image forming unit disposed above the sheet feed tray and configured to form an image on the sheet conveyed from the sheet feed tray;

a tray accommodating portion located below the image forming unit and configured to accommodate the sheet feed tray such that the sheet feed tray is movable in a first direction from an accommodated position where the sheet feed tray is accommodated in the tray accommodating portion toward a drawn position where the sheet feed tray is drawn from the tray accommodating portion;

a feed roller disposed upstream of the first guide when the sheet feed tray is at the accommodated position, the feed roller being configured to convey a sheet in a sheet conveying direction from the sheet feed tray accommodated in the tray accommodating portion to the first guide; and a second guide configured to guide the sheet conveyed by the feed roller from the sheet feed tray accommodated in the tray accommodating portion;

a guide member disposed at the sheet feed tray, the guide member being movable between a protruding position and a withdrawn position, wherein, when the guide member is at the protruding position, the guide member is disposed downstream of the first guide in the sheet conveyance direction and upstream of the second guide in the first direction such that the guide member overlaps the second guide in the first direction, and wherein, when the guide member is at the withdrawn position, the guide member does not overlap the second guide in the first direction; and a contact portion located at the main body, the contact portion being configured to, as the sheet feed tray moves from the tray accommodating portion, contact and move the guide member from the protruding position toward the withdrawn position.

* * * * *